US007611592B2

(12) United States Patent
Davis et al.

(10) Patent No.: US 7,611,592 B2
(45) Date of Patent: Nov. 3, 2009

(54) METHODS OF BETA PROCESSING TITANIUM ALLOYS

(75) Inventors: R. Mark Davis, Marshville, NC (US); Matthew J. Arnold, Charlotte, NC (US)

(73) Assignee: ATI Properties, Inc., Albany, OR (US)

( * ) Notice: Subject to any disclaimer, the term of this patent is extended or adjusted under 35 U.S.C. 154(b) by 344 days.

(21) Appl. No.: 11/360,065

(22) Filed: Feb. 23, 2006

(65) Prior Publication Data

US 2007/0193018 A1 Aug. 23, 2007

(51) Int. Cl.
*C22F 1/16* (2006.01)
*C22F 1/18* (2006.01)

(52) U.S. Cl. ..... 148/671

(58) Field of Classification Search ..... 29/527.1, 29/527.5, 527.7; 148/669–671, 421; 420/417–421
See application file for complete search history.

(56) References Cited

U.S. PATENT DOCUMENTS

| | | | | |
|---|---|---|---|---|
| 2,857,269 | A | 10/1958 | Vordahl | |
| 3,313,138 | A | 4/1967 | Spring et al. | |
| 3,489,617 | A * | 1/1970 | Wuerfel | 148/670 |
| 3,635,068 | A | 1/1972 | Watmough et al. | |
| 3,686,041 | A | 8/1972 | Lee | |
| 4,053,330 | A | 10/1977 | Henricks et al. | |
| 4,067,734 | A | 1/1978 | Curtis et al. | |
| 4,098,623 | A | 7/1978 | Ibaraki et al. | |
| 4,197,643 | A | 4/1980 | Burstone et al. | |
| 4,309,226 | A | 1/1982 | Chen | |
| 4,482,398 | A | 11/1984 | Eylon et al. | |

(Continued)

FOREIGN PATENT DOCUMENTS

| | | |
|---|---|---|
| EP | 0 707 085 B1 | 7/1999 |
| EP | 1 083 243 A2 | 3/2001 |
| EP | 1 612 289 A | 1/2006 |

(Continued)

OTHER PUBLICATIONS

J. Williams, Thermo-mechanical processing of high-performance Ti alloys: recent progress and future needs, Journal of Materials Processing Technology, 117 (2001), p. 370-373.*

(Continued)

*Primary Examiner*—George Wyszomierski
*Assistant Examiner*—Mark L Shevin
(74) *Attorney, Agent, or Firm*—Kirkpatrick, & Lockhart Preston Gates Ellis LLP; Patrick J. Viccaro; John E. Grosselin, III

(57) ABSTRACT

Various non-limiting embodiments of the present invention relate to methods of processing titanium alloys wherein the alloys are subjected to deformation above the beta transus temperature ($T_\beta$) of the alloys. For example, one non-limiting embodiment provides a method of processing an alpha+beta or a near-beta titanium alloy comprising deforming a body of the alloy at a first temperature ($T_1$) that is above the $T_\beta$ of the alloy; recrystallizing at least a portion of the alloy by deforming and/or holding the body at a second temperature ($T_2$) that is greater than $T_1$; and deforming the body at a third temperature ($T_3$), wherein $T_1 \geqq T_3 > T_\beta$; wherein essentially no deformation of the body occurs at a temperature below $T_\beta$ during the method of processing the titanium alloy.

30 Claims, 2 Drawing Sheets

U.S. PATENT DOCUMENTS

| | | | | |
|---|---|---|---|---|
| 4,543,132 | A | 9/1985 | Berczik et al. | |
| 4,631,092 | A | 12/1986 | Ruckle et al. | |
| 4,687,290 | A | 8/1987 | Prussas | |
| 4,688,290 | A | 8/1987 | Hogg | |
| 4,714,468 | A | 12/1987 | Wang et al. | |
| 4,799,975 | A | 1/1989 | Ouchi et al. | |
| 4,808,249 | A | 2/1989 | Eyelon et al. | |
| 4,842,653 | A | 6/1989 | Wirth et al. | |
| 4,851,055 | A | 7/1989 | Eylon et al. | |
| 4,889,170 | A | 12/1989 | Mae et al. | |
| 4,975,125 | A | 12/1990 | Chakrabarti et al. | |
| 4,980,127 | A | 12/1990 | Parris et al. | |
| 5,026,520 | A * | 6/1991 | Bhowal et al. | 148/670 |
| 5,032,189 | A | 7/1991 | Eylon et al. | |
| 5,074,907 | A | 12/1991 | Amato et al. | |
| 5,080,727 | A | 1/1992 | Aihara et al. | |
| 5,141,566 | A | 8/1992 | Kitayama et al. | |
| 5,156,807 | A | 10/1992 | Nagata et al. | |
| 5,162,159 | A | 11/1992 | Tenhover et al. | |
| 5,169,597 | A | 12/1992 | Davidson et al. | |
| 5,173,134 | A | 12/1992 | Chakrabarti et al. | |
| 5,201,457 | A | 4/1993 | Kitayama et al. | |
| 5,244,517 | A * | 9/1993 | Kimura et al. | 148/670 |
| 5,264,055 | A | 11/1993 | Champin et al. | |
| 5,277,718 | A | 1/1994 | Paxson et al. | |
| 5,332,454 | A | 7/1994 | Meredith et al. | |
| 5,342,458 | A * | 8/1994 | Adams et al. | 148/670 |
| 5,442,847 | A | 8/1995 | Semiatin et al. | |
| 5,472,526 | A | 12/1995 | Gigliotti, Jr. | |
| 5,516,375 | A | 5/1996 | Ogawa et al. | |
| 5,545,268 | A | 8/1996 | Yashiki et al. | |
| 5,679,183 | A | 10/1997 | Takagi et al. | |
| 5,698,050 | A | 12/1997 | El-Soudani | |
| 5,795,413 | A | 8/1998 | Gorman | |
| 5,871,595 | A | 2/1999 | Ahmed et al. | |
| 5,954,724 | A | 9/1999 | Davidson | |
| 6,127,044 | A | 10/2000 | Yamamoto et al. | |
| 6,132,526 | A | 10/2000 | Carisey et al. | |
| 6,139,659 | A | 10/2000 | Takahashi et al. | |
| 6,187,045 | B1 | 2/2001 | Fehring et al. | |
| 6,200,685 | B1 | 3/2001 | Davidson | |
| 6,250,812 | B1 | 6/2001 | Ueda et al. | |
| 6,258,182 | B1 | 7/2001 | Schetky et al. | |
| 6,284,071 | B1 | 9/2001 | Suzuki et al. | |
| 6,332,935 | B1 * | 12/2001 | Gorman et al. | 148/508 |
| 6,387,197 | B1 | 5/2002 | Bewlay et al. | |
| 6,391,128 | B2 | 5/2002 | Ueda et al. | |
| 6,409,852 | B1 | 6/2002 | Lin et al. | |
| 6,536,110 | B2 | 3/2003 | Stanley et al. | |
| 6,539,607 | B1 | 4/2003 | Fehring et al. | |
| 6,558,273 | B2 | 5/2003 | Kobayashi et al. | |
| 6,632,304 | B2 | 10/2003 | Oyama et al. | |
| 6,663,501 | B2 | 12/2003 | Chen | |
| 6,773,520 | B1 | 8/2004 | Fehring et al. | |
| 6,800,153 | B2 | 10/2004 | Ishii et al. | |
| 2001/0050117 | A1 | 12/2001 | Oyama et al. | |
| 2003/0168138 | A1 | 9/2003 | Marquardt | |
| 2004/0055675 | A1 | 3/2004 | Kuramoto et al. | |
| 2004/0099350 | A1 | 5/2004 | Mantione et al. | |
| 2005/0257864 | A1 | 11/2005 | Marquardt et al. | |
| 2005/0284549 | A1 | 12/2005 | Woodfield et al. | |
| 2007/0193662 | A1 | 8/2007 | Jablokov et al. | |

FOREIGN PATENT DOCUMENTS

| | | | |
|---|---|---|---|
| GB | 2 337 762 | A | 12/1999 |
| JP | H01-279736 | A | 11/1989 |
| JP | H05-195175 | A | 8/1993 |
| JP | H09-215786 | A | 8/1997 |
| WO | WO 98/22629 | A | 5/1998 |

OTHER PUBLICATIONS

G. Lutjering and J.C. Williams, Titanium, Springer-Verlag, 2003, Ch. 5: Alpha+Beta Alloys, p. 177-201.*

S.L. Semiatin, et al., "The Thermomechanical Processing of Alpha/Beta Titanium Alloys," *Journal of Metals*, Jun. 1997, pp. 33-36.

I. Weiss, et al., "Thermomechanical Processing of Beta Titanium Alloys—An Overview," *Materials Science and Engineering*, *A243*, 1998, pp. 49-57.

I. Weiss, et al., "The Processing Window Concept of Beta Titanium Alloys", *Recrystallization '90*, ed. by T. Chandra, *The Minerals, Metals & Materials Society*, 1990, pp. 609-616.

F.H. Froes, et al., "The Processing Window for Grain Size Control in Metastable Beta Titanium Alloys", *Beta Titanium Alloys in the 80's*, ed. by R. Boyer and H. Rosenberg, *AIME*, 1984, pp. 161-184.

J. Myers, "Primary Working, A lesson From Titanium and its Alloys," ASM Course Book 27 Lesson, Test 9, Aug. 1994, pp. 3-4.

*Metals Handbook, Desk Edition, 2nd ed.*, J. R. Davis ed., ASM International, Materials Park, Ohio (1998), pp. 575-588.

S. Tamarisakandaia, et al., "Strain-Induced Porosity During Cogging of Extra-Low Interstitial Grade Ti-6AI-4V", *Journal of Materials Engineering and Performance*, vol. 10(2), Apr. 2001, pp. 125-130.

Y. V. R. K. Prasad, et al., "Hot Deformation Mechanism In Ti-6AI-4V with Transformed B Starting Microstructure: Commercial v. Extra Low Interstitial Grade", *Materials Science and Technology*, Sep. 2000, vol. 16, pp. 1029-1036.

P. A. Russo, "Influence of Ni and Fe on the Creep of Beta Annealed Ti-6242S", *Titanium '95: Science and Technology*, pp. 1075-1082.

Boyer, Rodney R., "Introduction and Overview of Titanium and Titanium Alloys: Applications," Metals Handbook, ASM Handbooks Online (2002).

Callister, Jr., William D., Materials Science and Engineering, An Introduction, Sixth Edition, John Wiley & Sons, pp. 180-184 (2003).

"Heat Treating of Nonferrous Alloys: Heat Treating of Titanium and Titanium Alloys," Metals Handbook, ASM Handbooks Online (2002).

Roach, M.D., et al., "Physical, Metallurgical, and Mechanical Comparison of a Low-Nickel Stainless Steel," Transactions on the 27th Meeting of the Society for Biomaterials, Apr. 24-29, 2001, p. 343.

Roach, M.D., et al., "Stress Corrosion Cracking of a Low-Nickel Stainless Steel," Transactions of the 27th Annual Meeting of the Society for Biomaterials, 2001, p. 469.

Hawkins, M.J. et al., "Osseointegration of a New Beta Titanium Alloy as Compared to Standard Orthopaedic Implant Metals," Sixth World Biomaterials Congress Transactions, Society for Biomaterials, 2000, p. 1083.

Jablokov et al., "Influence of Oxygen Content on the Mechanical Properties of Titanium-35Niobium-7Zirconium-5Tantalum Beta Titanium Alloy," Journal of ASTM International, Sep. 2005, vol. 2, No. 8, 2002, pp. 1-12.

Fedotov, S.G. et al., "Effect of Aluminum and Oxygen on the Formation of Metastable Phases in Alloys of Titanium with .beta.-Stabilizing Elements", lzvestiya Akademii Nauk SSSR, Metally (1974) pp. 121-126.

Long, M. et al., "Friction and Surface Behavior of Selected Titanium Alloys During Reciprocating-Sliding Motion", WEAR, 249(1-2), 158-168.

Takemoto Y et al., "Tensile Behavior and Cold Workability of Ti-Mo Alloys", Materials Transactions Japan Inst. Metals Japan, vol. 45, No. 5, May 2004, pp. 1571-1576.

Lampman, S., "Wrought and Titanium Alloys," ASM Handbooks Online, ASM International, 2002 (pdf is 20 pages total).

Roach, M.D., et al., "Comparison of the Corrosion Fatigue Characteristics of CPTi-Grade 4, Ti-6A1-4V ELI, Ti-6A1-7 Nb, and Ti-15 Mo", Journal of Testing and Evaluation, vol. 2, Issue 7, (Jul./Aug. 2005) (published online Jun. 8, 2005).

Jablokov et al., "The Application of Ti-15 Mo Beta Titanium Alloy in High Strength Orthopaedic Applications", Journal of ASTM International, vol. 2, Issue 8 (Sep. 2005) (published online Jun. 22, 2005).

Marquardt et al., "Beta Titanium Alloy Processed for High Strength Orthopaedic Applications, "Journal of ASTM International, vol. 2, Issue 9 (Oct. 2005) (published online Aug. 17, 2005).

Nutt, Michael J. et al., "The Application of Ti-15 Beta Titanium Alloy in High Strength Structural Orthopaedic Applications, "Program and Abstracts for The Symposium on Titanium Niobium, Zirconium, and Tantalum for Medical and Surgical Applications, Washington, D.C., Nov. 9-10, 2004 Abstract, p. 12.

Marquardt, Brian, "Ti-15Mo Beta Titanium Alloy Processed for High Strength Orthopaedic Applications, "Program and Abstracts for The Symposium on Titanium, Niobium, Zirconium, and Tantalum for Medical and Surgical Applications, Washington, D.C., Nov. 9-10, 2004 Abstract, p. 11.

Marquardt, Brian, "Characterization of Ti-15Mo for Orthopaedic Applications, "TMS 2005 Annual Meeting: Technical Program, San Francisco, CA, Feb. 13-17, 2005 Abstract, p. 239.

Imperial Metal Industries Limited, Product Specification for "IMI Titanium 205", The Kynoch Press (England) pp. 1-5. (publication date unknown).

Qazi, J.I. et al., "High-Strength Metastable Beta-Titanium Alloys for Biomedical Applications," JOM, Nov. 2004 pp. 49-51.

Tokaji, Keiro et al., "The Microstructure Dependence of Fatigue Behavior in Ti-15Mo-5Zr-3Al Alloy," Materials Science and Engineering A., vol. 213 (1996) pp. 86-92.

Allegheny Ludlum, "High Performance Metals for Industry, High Strength, High Temperature, and Corrosion-Resistant Alloys", (2000) pp. 1-8.

Disegi, John, Wrought Titanium—15% Molybdenum Implant Material, Original Instruments and Implants of the Association for the Study of International Fixation—AO ASIF, Oct. 2003.

Naik, Uma M. et al., Omega and Alpha Precipitation in Ti-15Mo Alloy, Titanium '80 Science and Technology—Proceedings of the 4th International Conference on Titanium, H. Kimura & O. Izumi Eds. May 19-22 (1980) pp. 1335-1341. (Best Available Copy).

Pennock, G.M. et al., "The Control of a Precipitation By Two Step Ageing in b Ti-15Mo," Titanium '80 Science and Technology—Proceedings of the 4th International Conference on Titanium, H. Kimura & O. Izumi Eds. May 19-22 (1980) pp. 1344-1350. (Best Available Copy).

Bowen, A. W., "On the Strengthening of A Metastable β-Titanium Alloy by ω- and α-Precipitation" *Royal Aircraft Establishment Technical Memorandum Mat 338*, (1980) pp. 1-15 and Figs 1-5.

Bowen, A. W., "Omega Phase Embrittlement in Aged Ti-15%Mo," *Scripta Metallurgica*, vol. 5, No. 8 (1971) pp. 709-715. (Best Available Copy).

SAE Aerospace Material Specification 4897A (issued Jan. 1997, revised Jan. 2003).

"ASTM Designation F2066-01 Standard Specification for Wrought Titanium-15 Molybdenum Alloy for Surgical Implant Applications (UNS R58150)," ASTM International (2000) pp. 1-4.

Disegi, J. A., "Titanium Alloys for Fracture Fixation Implants," *Injury International Journal of the Care of the Injured*, vol. 31 (2000) pp. S-D14-17.

Ho, W.F. et al., "Structure and Properties of Cast Binary Ti-Mo Alloys" *Biomaterials*, vol. 20 (1999) pp. 2115-2122.

*ASM Materials Engineering Dictionary*, J.R. Davis Ed., ASM International, Materials Park, OH (1992) p. 39.

*Metals Handbook, Desk Edition, 2nd Ed.*, J.R. Davis Ed., ASM International, Materials Park, OH (1998) pp. 575-578.

Allvac, Product Specification for "Allvac Ti-15 Mo," available at http://www.allvac.com/allvac/pages/Titanium/Ti15MO.htm, last visited Jun. 9, 2003 p. 1 of 1.

Lemons, Jack et al., "Metallic Biomaterials for Surgical Implant Devices," *BONEZone*, Fall (2002) p. 5-9 and Table.

"ASTM Designation F1801-97 Standard Practice for Corrosion Fatigue Testing of Metallic Implant Materials" ASTM International (1997) pp. 876-880.

Zardiackas, L.D. et al., "Stress Corrosion Cracking Resistance of Titanium Implant Materials," *Transactions of the 27th Annual Meeting of the Society for Biomaterials*, (2001).

"Datasheet: Timetal 21S", Alloy Digest, Advanced Materials and Processes (Sep. 1998), pp. 38-39.

"Stryker Orthopaedics TMZF® Alloy (UNS R58120)", printed from www.allvac.com/allvac/pages/Titanium/UNSR58120.htm.

ASTM Designation F 2066-01, "Standard Specification for Wrought Titanium-15 Molybdenum Alloy for Surgical Implant Applications (UNS R58150)".

"Technical Data Sheet: Allvac® Ti-15Mo Beta Titanium Alloy" (dated Jun. 16, 2004).

"Allvac TiOsteum and TiOstalloy Beat Titanium Alloys", printed from www.allvac.com/allvac/pages/Titanium/TiOsteum.htm.

* cited by examiner

METHODS OF BETA PROCESSING TITANIUM ALLOYS

BACKGROUND

The present invention generally relates to methods of beta processing titanium alloys. More specifically, various non-limiting embodiments of the present invention set forth herein relate to a methods of processing alpha+beta titanium alloys and near-beta titanium alloys wherein the alloy is subjected to deformation only at temperatures above the beta-transus temperature of the alloy. Other non-limiting embodiments relate to titanium alloys that have been processed in accordance with the disclosed methods.

Titanium has two allotropic forms, a "high temperature" beta ("β")-phase, which has a body centered cubic ("bcc") crystal structure, and a "low temperature" alpha ("α")-phase, which has a hexagonal close packed crystal structure. The temperature at which the α-phase transforms into the β-phase is known as the β-transus temperature (or simply "β-transus" or "$T_\beta$") of the alloy.

The β-transus of the alloy is dependent upon both the type and amount of alloying elements present in the alloy. For example, alloying elements that are isomorphous with the bcc crystal structure of the β-phase have a tendency to stabilize the β-phase at lower temperatures. That is, these alloying elements tend to lower the β-transus temperature of the alloy, thereby expanding the temperature range over which the β-phase is stable. Such alloying elements are known as β-stabilizing elements or "β-stabilizers". Generally speaking, the more β-stabilizers a titanium alloy contains, the lower the β-transus of the alloy will be. Examples of β-stabilizers include, but are not limited to, zirconium, tantalum, vanadium, molybdenum, and niobium. See e.g., *Metal Handbook, Desk Edition*, $2^{nd}$ *Ed*., J. R. Davis ed., ASM International, Materials Park, Ohio (1998) at pages 575-588, which are specifically incorporated by reference herein.

In contrast to the β-stabilizers discussed above, alloying elements such as aluminum and oxygen have a tendency to stabilize the α-phase of the alloy and are known as α-stabilizing elements or "α-stabilizers". That is, these alloying elements tend to raise the β-transus temperature of the alloy, thereby expanding the temperature range over which the α-phase is stable. Generally speaking the more α-stabilizers a titanium alloy contains, the higher the β-transus of the alloy will be.

Titanium alloys are generally divided into different categories based upon the type and amount of alloying elements in the alloy. For example, titanium alloys containing relatively large amounts of α-stabilizers are generally considered to be "alpha alloys" (or "α alloys"). Alpha alloys contain primarily α-phase at room temperature. One non-limiting example of an alpha alloy is Ti-3Al-2.5Sn. The addition of small amounts of β-stabilizers to an α alloy will result in the retention of some β-phase within the alloy. Such alloys are known as "near-alpha alloys" (or "near-α alloys"). One non-limiting example of a near-α alloy is Ti-6Al-2Sn-4Zr-2Mo.

Titanium alloys that contain similar amounts of α-stabilizers and β-stabilizers are known as "alpha+beta alloys" (or "α+β alloys"). Since these alloys have a higher content of β-stabilizers than near-α alloys, they contain more β-phase than near-α alloys. One non-limiting example of an α+β alloy is Ti-6Al-4V. If the amount of β-stabilizers in an α+β alloy is increased, a "near-beta alloy" (or "near-β alloy) can be formed. Near-β alloys generally have microstructures in which the β-phase is the predominant phase in terms of volume fraction at room temperature. One non-limiting example of a near-beta titanium alloy is Ti-5Al-2Sn-2Zr-4Mo-4Cr.

Titanium alloys that contain a sufficient amount of β-stabilizing elements to avoid formation of α-phase on quenching from the β-phase field are known as "beta alloys" (or "β alloys"). Depending upon the amount of β-stabilizers present, a β alloy can be metastable or stable. Metastable-β alloys contain sufficient amounts of β-stabilizing elements to retain an essentially 100% β-structure upon cooling from above the β-transus. However, on aging the metastable-β alloy below its $T_\beta$, α-phase precipitates can be formed. One non-limiting example of a metastable-β alloy is Ti-12Mo-6Zr-2Fe. In contrast, precipitation of α-phase will generally not occur on aging of a stable-β alloy. One non-limiting example of a stable-β alloy is Ti-35V-15Cr.

Since the various titanium alloys discussed above contain different types and amounts of alloying elements, both the processing characteristics and the properties of these alloys generally differ. For example, α alloys and near-α alloys are generally more difficult to work than β alloys at temperatures below the β-transus of the alloy, owing to the relatively low hot workability of the α-phase. Further, α alloys are generally not susceptible to age hardening heat treatments.

In contrast, α+β, near-β, and metastable-β alloys generally have higher ductility than α and near-α alloys and can be age hardened to some degree. However, because the ductility, work hardening and aging responses of these alloy types differ, the processing methods and routes used with one type of alloy may not be useful with another type of alloy. Consequently, it is generally necessary to carefully select the alloy composition and processing conditions to achieve the desired mechanical properties in the final product.

Conventional processing of cast ingots of α+β and near-β alloys to form billets or other mill products typically involves an initial deformation of the material above the β-transus to break up the cast structure of the ingot followed by cooling to a temperature below the β-transus where the α-phase can precipitate within the β-grains. Thereafter, the alloy is typically subjected to an intermediate deformation step at a temperature below the initial deformation temperature, and typically in the α+β phase field of the alloy, to introduce deformation strain energy (or "pre-strain") into the alloy. A final deformation and/or annealing step above the β-transus to recrystallize the β-grain structure occurs after the intermediate deformation step. After recrystallization, the alloy may undergo additional processing steps, for example forging, typically below the β-transus, to achieve a desired final configuration.

An intermediate deformation step in the α+β phase field is generally considered to be required in order to introduce sufficient strain energy into the alloy structure to drive recrystallization during the final deformation and/or annealing steps. However, during the intermediate deformation step, a variety of defects may be introduced into the alloy. For example, small voids or pores, known as "strain-induced porosity" or "SIP", may develop in the alloy. The presence of SIP in the alloy can be particularly deleterious to the alloy properties and can result in significant yield loss. In severe cases additional, costly processing steps, such as hot-isostatic pressing, may be required in order to eliminate SIP. Further, because the hot workability of α+β and near-β alloys is relatively poor at the intermediate deformation temperatures, inconsistent deformation may occur within the work piece, resulting in variation in structure and incomplete grain refinement. Additionally, significant yield loss due to surface cracking during intermediate deformation may also be encountered.

Much of the work done on processing titanium alloys has focused on methods of optimizing the microstructure of titanium alloys through control of thermo-mechanical processing steps. Methods for processing ingots of various titanium alloys into billets having a desired microstructure have been disclosed. For example, U.S. Pat. No. 3,489,617 ("the '617 Patent") discloses methods of processing ingots of an alpha, an alpha+beta, or an "alpha-lean beta" alloy (i.e.,an alloy which contains both α-stabilizers and β-stabilizers but has lesser amounts of β-stabilizers than the α-stabilizers) to refine the beta grain size of the alloy during processing. See the '617 Patent at col. 1, lines 25-29 and col. 2, lines 5-27. The disclosed methods include working an ingot at a temperature above $T_\beta$ of the alloy followed by annealing at a temperature at least as high as the working temperature to recrystallize the material, or simultaneously working and recrystallizing the material at a temperature above $T_\beta$ of the alloy. Further, according to the '617 Patent, after recrystallization of the beta grain structure, the alloy may be worked from a temperature in the beta field, but it is essential that the major portion of the reduction occur in the alpha-beta field to break up the alpha network. See col. 3, lines 40-53.

Various methods of processing titanium alloy billets into other configurations having a desired microstructure have also been disclosed. For example, U.S. Pat. No. 5,026,520 ("the '520 Patent") discloses a method of forming fine grain alpha or α+β titanium alloy forgings by isothermally pressing a billet of an α or α+β alloy at a temperature 50° F. to 100° F. above the alloy's $T_\beta$, followed by an isothermal hold at a temperature 50° F. to 100° F. above the alloy's $T_\beta$ and preferably equivalent to the forging temperature, and subsequently quenching to arrest grain growth. See the '520 Patent at col. 4, lines 29-58. A second processing step that occurs at the hold temperature and immediately after the holding step and before the quenching step may also be employed. See the '520 Patent at col. 4, lines 59-66.

U.S. Pat. No. 5,032,189 ("the '189 Patent") discloses processing near-α and α+β alloys by forging a billet of the alloy into a desired shape at a temperature at or above $T_\beta$ of the alloy, followed by heat treating the forged component at a temperature from about 4% below $T_\beta$ of the alloy to about 10% above $T_\beta$, rapidly cooling to obtain a martensitic-like structure, and annealing the component at a temperature in the range of 10-20% below $T_\beta$ of the alloy. See the '189 Patent at col. 2, line 48 to col. 3, line 3. U.S. Pat. No. 5,277,718 ("the '718 Patent") discloses a titanium alloy billet, and in particular billets of β-stabilized α+β alloys and β alloys, having improved response to ultrasonic inspection where the billet is thermomechanically treated above $T_\beta$ of the alloy immediately prior to ultrasonic inspection. See the Abstract of the '718 Patent.

Despite the efforts aimed at improving the microstructure of titanium alloys via thermo-mechanical processing, comparatively little attention appears to have been focused on methods of processing titanium alloys to reduce or eliminate the occurrence of processing related defects, such as SIP. In "Strain-Induced Porosity During Cogging of Extra-Low Interstitial Grade Ti-6Al-4V," *Journal of Materials Engineering and Performance*, Vol. 10 (2) April 2001, pp. 125-130, Tamirlsakandala et al. describe investigation of the origin of SIP development during intermediate processing of in extra-low interstitial (or "ELI") Ti-6Al-4V. In particular, Tamirlsakandala et al. describe establishing constitutive equations and processing maps by subjecting an ingot of ELI Ti-6Al-4V, which was previously deformed by cogging above $T_\beta$ and subsequently cooled below $T_\beta$ to achieve a lamellar α (i.e., transformed β) microstructure, to various isothermal hot compression tests at temperatures below, near and above $T_\beta$. See Tamirlsakandala et al. at p. 126. Based on this work, the authors suggest introducing a differential temperature into the billet with lower mid-plane temperature and higher surface temperature to avoid formation of SIP during cogging of the alloy. See Tamirlsakandala et al. at p. 130.

U.S. Patent Application Publication No. 2004/0099350 discloses methods of reducing the incidence of SIP in titanium alloys via control of the alloy content.

Accordingly, there remains a need for methods of processing titanium alloys, and in particular, α+β and near-β titanium alloys, that can reduce or eliminate the occurrence of SIP and/or other processing related defects, while still achieving a desired microstructure.

BRIEF SUMMARY OF DISCLOSURE

Various non-limiting embodiments disclosed herein relate to methods of processing titanium alloys. For example, various non-limiting embodiments provide a method of processing a titanium alloy comprising: deforming a body of the titanium alloy at a first temperature ($T_1$) that is above the beta-transus temperature ($T_\beta$) of the alloy; at least one of: (i) deforming the body at a second temperature ($T_2$) that is greater than $T_1$ to recrystallize at least a portion of the titanium alloy, or (ii) holding the body at $T_2$ for a time period sufficient to recrystallize at least a portion of the titanium alloy; and deforming the body at a third temperature ($T_3$), wherein $T_1 \geqq T_3 > T_\beta$; wherein the titanium alloy is one of an α+β titanium alloy and a near-β titanium alloy, and wherein essentially no deformation of the body occurs at a temperature below $T_{62}$ during the method of processing the titanium alloy.

Other non-limiting embodiments provide a method of processing an alpha+beta or a near-beta titanium alloy, the method comprising: deforming the titanium alloy at a first temperature ($T_1$) that is above the beta-transus temperature ($T_\beta$) of the titanium alloy; recrystallizing at least a portion of the alloy by at least one of deforming or holding the titanium alloy at a temperature that is at least 50° F. greater than $T_1$; deforming the titanium alloy at a temperature ranging from greater than $T_\beta$ up to $T_1$; and cooling the titanium alloy to a temperature below $T_\beta$ without deforming the titanium alloy during cooling; wherein between deforming the titanium alloy at $T_1$ and cooling the titanium alloy to a temperature below $T_\beta$, deformation of the titanium alloy occurs only at temperatures above $T_\beta$.

Still other non-limiting embodiments provide a method of processing an ingot of a titanium alloy, the method comprising: heating the ingot until at least a portion of the ingot attains a first temperature ($T_1$) that is at least 50° F. above the beta-transus temperature ($T_\beta$) of the titanium alloy; deforming the ingot at $T_1$ to attain a total percent reduction in cross-sectional area of at least 15 percent during deformation at $T_1$; heating the ingot until at least a portion of the ingot attains a second temperature ($T_2$) that is at least 50° F. greater than $T_1$; at least one of: (i) deforming the body at $T_2$ to recrystallize at least a portion of the titanium alloy, or (ii) holding the ingot at $T_2$ for a time period sufficient to recrystallize at least a portion of the titanium alloy; allowing at least a portion of the ingot to attain a third temperature ($T_3$), wherein $T_1 \geqq T_3 > T_\beta$; and deforming the ingot at $T_3$ to attain a total percent reduction in cross-sectional area of at least 15 percent during deformation at $T_3$, wherein the titanium alloy is one of an α+β titanium alloy and a near-β titanium alloy, and wherein between the steps of deforming the ingot at $T_1$ and deforming the ingot at $T_3$, essentially no deformation of the ingot occurs at a temperature below $T_\beta$.

Still other non-limiting embodiments provide α+β and near-β titanium alloy bodies that are essentially free of deformation below $T_\beta$ of the alloy and free of strain induced porosity.

BRIEF DESCRIPTION OF THE SEVERAL VIEWS OF THE DRAWING(s)

Various non-limiting embodiments of the invention may be better understood when read in conjunction with the drawings in which.

DETAILED DESCRIPTION OF VARIOUS NON-LIMITING EMBODIMENTS OF THE INVENTION

Figure 1:
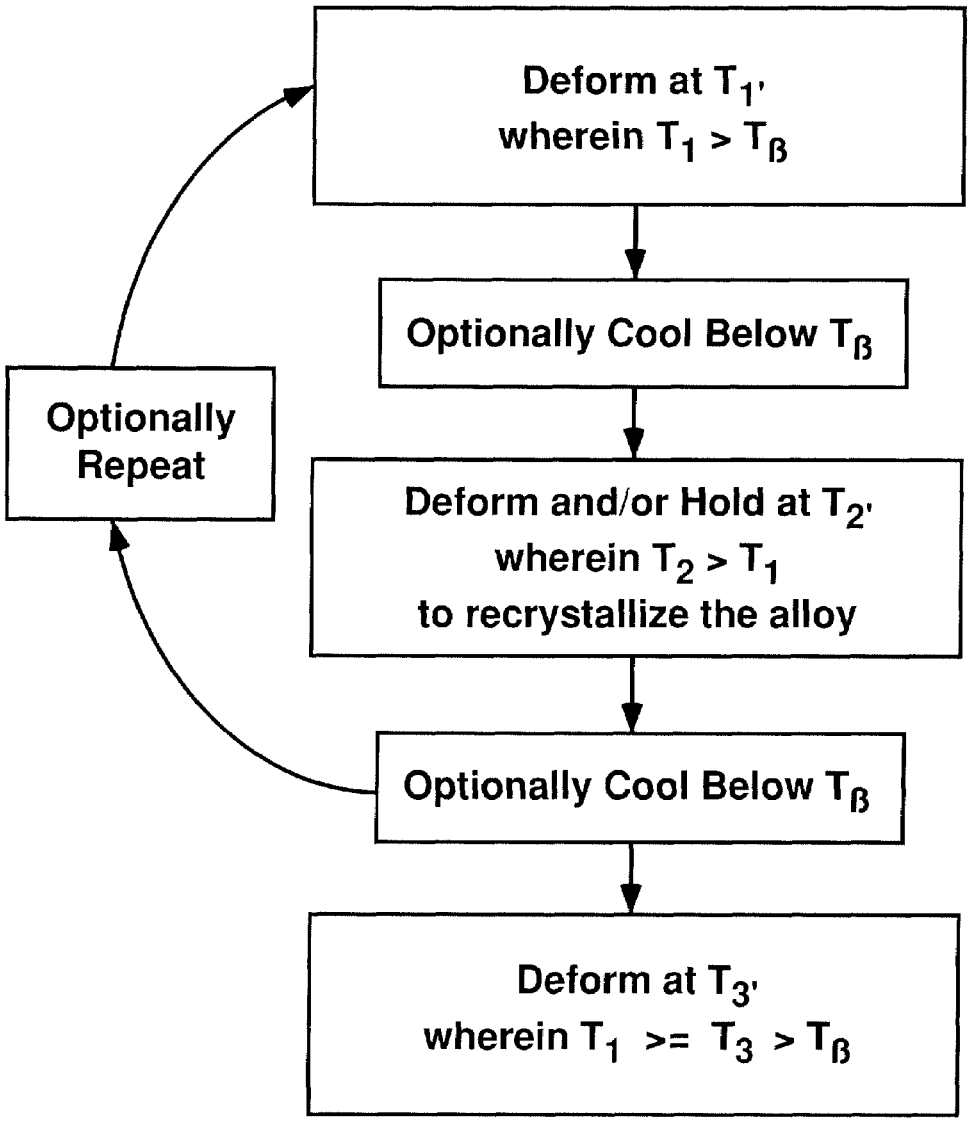
FIG. 1 is a schematic diagram of a method of processing a body of a titanium alloy according to various non-limiting embodiments disclosed herein.

Various non-limiting embodiments of the present invention will now be described. It is to be understood that the present description illustrates aspects of the invention relevant to a clear understanding of the invention. Certain aspects of the invention that would be apparent to those of ordinary skill in the art and that, therefore, would not facilitate a better understanding of the invention have not been presented in order to simplify the present description. Although the present invention is described herein in connection with certain embodiments and examples, the present invention is not limited to the particular embodiments and examples disclosed, but is intended to cover modifications that are within the spirit and scope of the invention, as defined by the appended claims.

As used in this specification and the appended claims, the articles "a," "an," and "the" include plural referents unless expressly and unequivocally limited to one referent. Additionally, for the purposes of this specification, unless otherwise indicated, all numbers expressing quantities, such as weight percentages and processing parameters, and other properties or parameters used in the specification are to be understood as being modified in all instances by the term "about." Accordingly, unless otherwise indicated, it should be understood that the numerical parameters set forth in the following specification and attached claims are approximations. At the very least, and not as an attempt to limit the application of the doctrine of equivalents to the scope of the claims, numerical parameters should be read in light of the number of reported significant digits and the application of ordinary rounding techniques.

Further, while the numerical ranges and parameters setting forth the broad scope of the invention are approximations as discussed above, the numerical values set forth in the Examples section are reported as precisely as possible. It should be understood, however, that such numerical values inherently contain certain errors resulting from the measurement equipment and/or measurement technique. Furthermore, when numerical ranges are set forth herein, these ranges are inclusive of the recited range end point(s).

As used herein the terms "β-transus temperature" and "β-transus" (also denoted "$T_\beta$") refer to the minimum temperature above which equilibrium α-phase does not exist in the titanium alloy. See e.g., *ASM Materials Engineering Dictionary*, J. R. Davis Ed., ASM International, Materials Park, Ohio (1992) at page 39, which is specifically incorporated by reference herein. As used herein the term "alpha+beta alloy(s)" (or "α+β alloy(s)") refers to titanium alloys that contain at least one α-stabilizer and at least one β-stabilizer, and contain from approximately 10 up to 50 volume percent β-phase at room temperature. Further, as used herein, the term "near-beta alloy(s)" (or "near-β alloy(s)") refers to titanium alloy(s) containing both α-stabilizing elements and β-stabilizing elements, and having β-phase as the predominant phase by volume fraction at room temperature.

As discussed above, conventional processing of α+β and near-β titanium alloys generally requires the introduction of a certain amount of pre-strain into the alloy, typically by deforming or working the alloy in the α+β phase field, in order to drive recrystallization during a subsequent β-annealing or deformation step. Conventional processing of α+β and near-β alloys typically also includes a final deformation step in the α+β phase field to break-up or refine the α-phase of the alloy. However, when α+β and near-β titanium alloys are deformed within the α+β phase field, that is, below $T_\beta$ of the alloy, various processing defects, such as SIP, may be introduced into the alloy. However, the inventors herein have observed that it is possible to reduce or eliminate the occurrence of SIP, while still providing a titanium alloy having a desired microstructure, by processing the alloy without subjecting it to deformation processes within the α+β phase field. That is, the inventors herein have observed that it is possible forego the typical α+β deformation (e.g., pre-strain and α refining) steps while still achieving a desired microstructure using an all β deformation process.

Referring now to FIG. 1, various non-limiting embodiments disclosed herein relate to methods of processing a titanium alloy, and in particular an α+β or a near-β titanium alloy, comprising deforming a body of the titanium alloy at a first temperature ($T_1$) that is above the beta-transus temperature ($T_\beta$) of the alloy; recrystallizing at least a portion of the titanium alloy by at least one of: (i) deforming the body at a second temperature ($T_2$) that is greater than $T_1$ to recrystallize at least a portion of the titanium alloy, or (ii) holding the body at $T_2$ for a time period sufficient to recrystallize at least a portion of the titanium alloy; and deforming the body at a third temperature ($T_3$), wherein $T_1 \geqq T_3 > T_\beta$; wherein essentially no deformation of the body occurs at a temperature below $T_\beta$ during the method of processing the titanium alloy. That is, during processing of the titanium alloy according to these non-limiting embodiments of the invention, no deformation or "work" is intentionally introduced into the titanium alloy body while the alloy is within the α+β phase field.

As discussed above, conventional processing of α+β and near-β alloys involves deformation occurring below $T_\beta$, in the α+β phase field. However, according to various non-limiting embodiments disclosed herein, the titanium alloy body is deformed only at temperatures above $T_\beta$ during the method of processing the alloy, thereby reducing or eliminating the occurrence of SIP during processing.

Non-limiting examples of α+β titanium alloys that can be processed in accordance with various non-limiting embodiments disclosed herein include Ti-8Al-1Mo-1V (having a composition designated UNS-R54810), Ti-6Al-4V (also denoted "Ti-6-4", having a composition designated UNS-R56400), Ti-6Al-6V-2Sn (having a composition designated as UNS-R56620), and Ti-6Al-2Sn-2Zr-2Mo-2Cr. It will be appreciated by those skilled in the art that the foregoing alloy designations refer only to the major alloying elements contained in the titanium alloy on a weight percent basis of the total alloy weight, and that these alloys may also include other minor additions of alloying elements that do not effect the designation of the alloys as $\alpha+\beta$ titanium alloys. According to one specific non-limiting embodiment, the $\alpha+\beta$ alloy is a Ti-6Al-4V alloy.

Non-limiting examples of near-$\beta$ titanium alloys that can be used in connection with various non-limiting embodiments disclosed herein include, but are not limited to, Ti-5Al-2Sn-2Zr-4Mo-4Cr (also denoted "Ti-17", having a composition designated UNS-R58650), Ti-6Al-2Sn-2Zr-2Cr-2Mo-0.15Si (also denoted "Ti-62222"), and Ti-4.5Al-3V-2Mo-2Fe (also denoted "SP-700"). It will be appreciated by those skilled in the art that the foregoing alloy designations refer only to the major alloying elements contained in the titanium alloy on a weight percent basis of the total alloy weight, and that these alloys may also include other minor additions of alloying elements that do not effect the designation of the alloys as near-$\beta$ titanium alloys. According to one specific non-limiting embodiment, the near-$\beta$ titanium alloy is a Ti-5Al-2Sn-2Zr-4Mo-4Cr (or Ti-17 alloy).

Although not limiting herein, the titanium alloy body according to various non-limiting embodiments disclosed herein may be a cast ingot. Further, according to various non-limiting embodiments disclosed herein, the cast ingot may be subjected to a homogenization process (or other standard processes) prior to processing the alloy in accordance with the methods disclosed herein. Homogenization generally involves subjecting the cast ingot to elevated temperatures for a period of time sufficient to cause any segregation of alloying elements that occurred during the casting process to be substantially reduced or eliminated. The precise method of homogenization employed is not believed to be critical to the present invention and suitable homogenization processes for titanium alloys are well known in the art.

According to various non-limiting embodiments disclosed herein, the titanium alloy body may be a homogenized, cast ingot that is converted into a mill product or a semi-finished product by processing the ingot in accordance with the methods disclosed herein. Non-limiting examples of mill products or semi-finished products that may be produced in accordance with the methods disclosed herein include billets, rods, bars, coils, slabs, sheets, plates and the like.

According to other non-limiting embodiments disclosed herein, the titanium alloy body can be a mill product or semi-finished product (such as a billet, etc.) that is converted into a finished product by processing the mill product according to the foregoing methods.

As previously discussed, according to various non-limiting embodiments disclosed herein, a titanium alloy body may be deformed at a first temperature ($T_1$) that is above the beta-transus temperature ($T_\beta$) of the titanium alloy. Deforming the titanium alloy body according to various non-limiting embodiments disclosed herein may involve deforming a portion of the body or the entire body. Further, as used herein phrases such as "deforming at" or "deforming the body at," etc., with reference to a temperature, a temperature range or a minimum temperature, mean that at least the portion of the object to be deformed has a temperature at least equal to the referenced temperature or within the referenced temperature range throughout its extent during deformation. Still further, as used terms such as "heated to" or "heating to," etc., with reference to a temperature, a temperature range or a minimum temperature, mean that the object is heated until at least the desired portion of the object has a temperature at least equal to the referenced temperature or within the referenced temperature range throughout its extent.

For example, according to various non-limiting embodiments disclosed herein, prior to deforming the body at $T_1$, the body may be heated to $T_1$, or a temperature above $T_1$, for example in a furnace or between heated dies or the like, such that the body, or at least the portion of the body to be deformed, attains a temperature of at least $T_1$ throughout its extent. Thereafter, the body (or any portion thereof) can be deformed at $T_1$. Alternatively, if the deformation apparatus is heated, for example an isothermal forging press, the body or portion thereof can be heated to $T_1$ in the deformation apparatus and thereafter the body or portion thereof can be deformed at $T_1$.

It will be appreciated by those skilled in the art that during deformation, the body may cool such that the temperature of the body drops below $T_\beta$, particularly if multiple deformation passes are utilized. Accordingly, the body, or any portion thereof, can be heated during the deformation process or reheated between deformation passes as needed to assure that deformation of the body occurs above $T_\beta$ of the alloy. Further, if multiple deformation passes are employed, the body may be intentionally cooled below $T_\beta$ between any consecutive passes, provided that the body is reheated prior to subsequent passes. If multiple passes are used, however, it is not necessary that each pass be conducted at exactly the same temperature, provided that for each pass, the body is deformed at a temperature that is above $T_\beta$ of the alloy. For example, as discussed below, according to various non-limiting embodiments, $T_1$ may any temperature that is at least 50° F. greater than $T_\beta$. According to other non-limiting embodiments, $T_1$ can be any temperature ranging from 50° F. to 800° F. greater than $T_\beta$.

Non-limiting examples of methods of deforming the titanium alloy bodies that may be used in accordance with various non-limiting embodiments disclosed herein include forging, cogging, extrusion drawing, and rolling. For example, according to one specific non-limiting embodiment, deforming at least a portion of the body at $T_1$ can comprise forging the body at $T_1$.

Non-limiting methods of forging titanium alloys are generally known in the art. Common methods of forging titanium alloys include straight draw forging, upset forging, and combinations thereof. As will be appreciated by those skilled in the art, straight draw forging generally involves the application of forces to an elongated work piece, wherein the forces are applied radially inward (e.g., perpendicular to the longitudinal axis of the work piece) to affect a reduction in the cross-sectional area of the work piece while concurrently increasing the length of the work piece. Upset forging generally involves the application of forces to an elongated work piece, wherein the forces are applied longitudinally (e.g., parallel to the longitudinal axis of the work piece) to affect a reduction in the length of the work piece while concurrently increasing the diameter of the work piece.

As mentioned above, according to various non-limiting embodiments disclosed herein, deforming the body at $T_1$ may involve a single deformation step or, alternatively, may involve multiple deformation steps or passes in order to obtain a desired configuration (e.g., size, shape, etc.) of the alloy body. Further, if multiple deformation steps are employed, as mentioned above, it may be necessary to subject the body to various reheating steps between deformation passes in order to ensure that the temperature of the body is at least at the desired temperature or within the desired temperature range during subsequent deformation passes. For example, according to one non-limiting embodiment, deforming the body at $T_1$ may comprise heating the body (or at least the portion of the body to be deformed) to $T_1$, forging the body at $T_1$ in a first forging pass, reheating the body, and subsequently forging the body at $T_1$ in a second forging pass. As discussed in more detail below, the percent reduction in area taken in each pass can be such that the total reduction in area of the body after deforming at $T_1$ ranges from about 15% to about 80%. For example, according to one non-limiting embodiment, the first forging pass may comprise a reduction in cross-sectional area of the body ranging from about 30% to about 50%, the second forging pass may comprises a reduction in cross-sectional area of the body ranging from 30% to about 50%, and the total reduction in cross-sectional area after deforming at $T_1$ can range from 60% to 70%.

As used herein the term "total percent reduction in cross-sectional area" refers to the difference between the cross-sectional area of the body prior to deformation at the referenced temperature ("$A_i$") and the cross-sectional area of the body on completion of all deformation passes at the referenced temperature ("$A_f$") as a percentage of the cross-sectional area of the body prior to deformation at the referenced temperature ("$A_i$"), which can be expressed as: $(A_i-A_f)/A_i\times 100$. Thus, if deforming the body at $T_1$ involves a single deformation pass or step, the total percent reduction in cross-sectional area is the difference between the cross-sectional area of the body prior to deformation at $T_1$ and the cross-sectional area of the body after the single deformation pass at $T_1$ as a percentage of the cross-sectional area of the body prior to deformation at $T_1$. If deforming the body at $T_1$ involves two or more deformation passes or steps, the total percent reduction in cross-sectional area is the difference between the cross-sectional area of the body prior to deformation at $T_1$ and the cross-sectional area of the body on completion of all the deformation passes at $T_1$ as a percentage of the cross-sectional area of the body prior to deformation at $T_1$. Further, the percent reduction in cross-sectional area for any given deformation pass is the difference between the cross-sectional area of the body immediately before deformation and the cross-sectional area of the body immediately thereafter as a percentage of the cross-sectional area of the body immediately before deformation.

Although not meant to be limiting herein, it is contemplated by the inventors that a certain level of work should be introduced into the body during deformation at $T_1$ in order to impart sufficient strain energy into the alloy to drive subsequent recrystallization of the alloy. According to certain non-limiting embodiments disclosed herein, deforming the body at $T_1$ may comprise deforming or working the body, in one or more passes or steps, to impart sufficient strain energy into the alloy body so as to allow at least a portion of the body, or the entire body, to recrystallize during the subsequent recrystallization process. For example, according to one non-limiting embodiment, deforming the body at $T_1$ may comprise deforming the body to attain a total percent reduction in cross-sectional area of at least 15% up to 80% during deformation at $T_1$. According to other non-limiting embodiments, deforming the body at $T_1$ may comprise deforming the body to attain a total percent reduction in cross-sectional area ranging from 20% to 70%. Further, according other non-limiting embodiments, deforming the body at $T_1$ may comprise deforming the body to attain a total percent reduction in cross-sectional area ranging from 25% to 65% during deformation at $T_1$.

However, it should be appreciated that the precise amount of work that must be introduced during deformation at $T_1$ will depend, in part, on the composition of the alloy, as well as the desired percent recrystallization and subsequent recrystallization process employed. Thus, it is contemplated by the inventors that total reductions in cross-sectional area of less than 15% or more than 80% may be desirable in certain circumstances. For example, for applications requiring less than complete recrystallization, total reductions in cross-sectional area less than 15% may be employed.

As discussed above, according to various non-limiting embodiments disclosed herein, $T_1$ can be any temperature that is at least 50° F. greater than $T_\beta$ (i.e., $T1 \geqq T_\beta+50°$ F.). According to other non-limiting embodiments, $T_1$ can be any temperature ranging from 50° F. to 800° F. greater than $T_\beta$ (i.e., $T_\beta+800° F. \geqq T_1 \geqq T_\beta+50°$ F.). It is contemplated by the inventors that if $T_1$ is a temperature that is substantially less than $T_\beta+50°$ F., it may be difficult to ensure the temperature of the body will not fall below $T_\beta$ during deformation using standard processing equipment. However, the present disclosure also contemplates the use of temperatures closer to $T_\beta$ (e.g., $T_\beta+10°$ F.) if greater temperature control is possible, for example using an isothermal press. Further, although not limiting herein, it is contemplated by the inventors that if $T_1$ exceeds $T_\beta+800°$ F., an undesirable amount of grain growth may occur. Nevertheless, the present disclosure contemplates the use of temperatures greater than $T_\beta+800°$ F., provided the microstructure achieved is acceptable.

It will be appreciated by those skilled in the art that the precise value of the β-transus temperature $T_\beta$ of an alloy will depend on the composition of the alloy being processed and that slight variations in composition can affect a change in $T_\beta$. For example, as previously discussed, some alloying elements have a tendency to decrease $T_\beta$ of the alloy, while other alloying elements have a tendency to increase $T_\beta$ of the alloy, and still other alloying elements have little to no effect on $T_\beta$. Although not meant to be limiting herein, a typical range of $T_\beta$ values for several common α+β and near-β titanium alloys having the designations indicated are provided in Table 1 for illustration purposes. It should be appreciated, however, that the $T_\beta$ value for any given alloy having a composition falling within a particular designation may vary from the tabled value due to compositional variations within that designation. Methods of determining $T_\beta$ values are generally known to those skilled in the art and can be applied, as necessary, to determine the $T_\beta$ of the alloy to be processed.

TABLE 1

| Alloy Designation | Alloy Type | Typical $T_\beta$** |
|---|---|---|
| Ti—6Al—2Sn—4Zr—2Mo | near-α | 1825° F. ± 25° F. |
| Ti—8Al—1Mo—1V | α + β | 1900° F. ± 25° F. |
| Ti—6Al—4V | α + β | 1815° F. ± 25° F. |
| Ti—6Al—6V—2Sn | α + β | 1733° F. ± 25° F. |
| Ti—6Al—2Sn—4Zr—6Mo | α + β | 1715° F. ± 25° F. |
| Ti—6Al—2Sn—2Zr—2Mo—2Cr | α + β | 1760° F. ± 25° F. |
| Ti—5Al—2Sn—2Zr—4Mo—4Cr | near-β | 1635° F. ± 25° F. |

**Source: "Titanium Alloys", Materials Properties Handbook, Published by ASM International (1994)

Although not required, as indicated in FIG. 1, according to various non-limiting embodiments disclosed herein, after deforming the body at $T_1$, the body (or any portion thereof) may be cooled to a temperature below $T_\beta$ of the titanium alloy prior to recrystallizing at least a portion of the alloy. For example, although not limiting herein, the body may be cooled by water quenching, forced air cooling or another suitable method that provides a cooling rate that is sufficiently rapid to avoid excessive growth of the β-grains and/or permits the retention of a sufficient amount of strain in the alloy to drive the subsequent recrystallization process. Thereafter, at least a portion of the alloy to be recrystallized may be heated to $T_2$, or above, and held for a time period sufficient to recrystallize at least a portion of the alloy and/or deformed at $T_2$ to recrystallize at least a portion of the alloy.

Alternatively, after deforming at $T_1$, at least a portion of the alloy may be recrystallized without cooling below $T_\beta$. For example, according to one non-limiting embodiment after deforming at $T_1$, the body may be directly heated to $T_2$, or above, and held for a time period sufficient to recrystallize at least a portion of the alloy. Additionally or alternatively, the body can be directly heated and deformed at $T_2$ to recrystallize at least a portion of the alloy. As used herein, phrases such as "holding the body at" or "hold at," etc., with reference to a temperature, temperature range or minimum temperature, mean that at least the potion of the object to be recrystallized is maintained at a temperature at least equal to the referenced temperature or within the referenced temperature range. For example, according to one non-limiting embodiment, after deforming at $T_1$, the body may be heated (with or with out prior cooling below $T_\beta$) to $T_2$, wherein $T_2$ is at least $T_1$+50° F., and subsequently held at $T_2$ such that the body (or portion thereof to be recrystallized) is maintained at a temperature of at least $T_2$ for a time period sufficient to recrystallize at least the desired portion of the titanium alloy.

As previously discussed, according to various non-limiting embodiments disclosed herein, an amount of strain energy sufficient to permit the recrystallization of at least a portion of the alloy body during processing at $T_2$ is introduced into the body during deformation at $T_1$. Although not limiting herein, it is contemplated by the inventors that in order to recrystallize the alloy after deforming at $T_1$, it is generally necessary that the second temperature $T_2$ be higher than the first temperature $T_1$. However, if $T_2$ is too high, excessive and undesired grain growth may occur. Therefore, according to various non-limiting embodiments disclosed herein, the temperature $T_2$ may be chosen to achieve the desired level of recrystallization while minimizing grain growth during recrystallization.

For example, according to various non-limiting embodiments disclosed herein, $T_2$ may be at least 50° F. greater than $T_1$. For example, according to one non-limiting embodiment, $T_2$ may range from $T_1$+50° F. to $T_1$+800° F. According to another non-limiting embodiment, $T_2$ may range from $T_1$+75° F. to $T_1$+500° F. According to still another non-limiting embodiment, $T_2$ may range from $T_1$+100° F. to $T_1$+200° F. According to yet another non-limiting embodiment $T_2$ is at least $T_1$+150° F. However, it should be appreciated that the precise temperature necessary for recrystallization of at least a portion of the alloy may depend on the alloy composition, the size and configuration of the alloy body, the grain size or morphology of the alloy after deformation at $T_1$, and the amount of strain energy introduced into the body during deformation at $T_1$. Accordingly, it is contemplated by the inventors that the temperature $T_2$ may be lower than $T_1$+50° F., provided that at least a portion of the body is recrystallized during processing at $T_2$. Further, the inventors contemplate that $T_2$ may be greater than $T_1$+800° F. provided that excessive grain growth does not occur during processing at $T_2$.

As discussed above, according to various non-limiting embodiments disclosed herein at least a portion of the alloy is recrystallized by at least one of (i) deforming the body at $T_2$ or (ii) holding the body at $T_2$ for a time period sufficient to recrystallize at least a portion of the body. According to one non-limiting embodiment, the body is held at $T_2$ for a time period sufficient to recrystallize at least 50% of the body, at least 75% of the body, or 100% of the body. However, it will be appreciated by those skilled in the art that the precise period of time required to achieve the desired level of recrystallization will vary, in part, on the desired level of recrystallization, the temperature employed, and the amount of strain energy introduced during deformation at $T_1$, as well as the alloy composition, and the size and configuration of the alloy body itself. Thus, for example, if the body has a relatively small, uniform cross-section and/or $T_2$ is relatively high, the time required to achieve the desired level of recrystallization the body may be relatively short—for example, on the order of a few minutes to a few hours. However, if the body has a relatively large, non-uniform cross-section and/or $T_2$ is relatively low, the time required to achieve the desired level of recrystallization may be relatively long—for example, on the order of several hours. For example, although not limiting herein, according to certain non-limiting embodiments disclosed herein, the hold time period at $T_2$ may range 30 minutes to 10 hours.

According to another non-limiting embodiment, the body may be recrystallized by deforming at $T_2$ such that at least 50% of the body, at least 75% of the body, or 100% of the body is recrystallized. Further, according to these non-limiting embodiments, deforming the body at $T_2$ may include forging, drawing, rolling, etc. Although not required, the body may be deformed at $T_2$ using the same deformation process as used to deform the body at $T_1$, or alternatively, a different deformation process may be employed. Additionally, the amount of deformation imparted during deformation at $T_2$ can range from about 15% to about 80% total reduction in cross-sectional area.

As discussed above with respect to deformation of the body at $T_1$, according to various non-limiting embodiments disclosed herein, deforming the body at $T_2$ can involve a single deformation step or, alternatively, can involve multiple deformation steps. As previously discussed, if multiple deformation steps are employed, it may be necessary to subject the body to various reheating steps between deformation passes in order to maintain the temperature of the body within the desired range; however, it is not necessary that each pass be conducted at exactly the same temperature, provided that for each pass, the body is deformed at temperature that is greater than $T_1$. Further, if multiple deformation steps are employed, the body may be cooled below $T_\beta$ between any consecutive passes provided that the body is reheated prior to deforming the body.

Referring again to FIG. 1, according to various non-limiting embodiments disclosed herein, prior to deforming the body at $T_3$, the body may be subjected to one or more additional cycles of deformation at $T_1$ and recrystallization at $T_2$ (i.e., deforming and/or holding the body at $T_2$ to recrystallize the alloy), which may be the same or different from the previous deformation and recrystallization cycle(s). For example, according to one non-limiting embodiment the body is subjected to at least two cycles of deforming the body at $T_1$ and deforming or holding the body at $T_2$, wherein for each of the at least two cycles $T_1$ is independently chosen and ranges from $T_\beta$+50° F. to $T_\beta$+800° F. and $T_2$ is independently chosen and ranges from $T_1$ +50° F. to $T_1$+800° F. That is, for each cycle, the temperatures $T_1$ and $T_2$ can be the same as or different from the temperatures $T_1$ and $T_2$ employed in the previous cycle(s), provided that, for each cycle, $T_1$ is a temperature ranging from $T_\beta$+50° F. to $T_\beta$+800° F. and $T_2$ is a temperature ranging from $T_1$+50° F. to $T_1$+800° F.

Further, although not required, as indicated in FIG. 1, according to various non-limiting embodiments disclosed herein, after holding and/or deforming the body at $T_2$, the body may be cooled to a temperature below $T_\beta$ of the titanium alloy prior to deforming the body at $T_3$ (or prior to conducting an additional cycle of deformation at $T_1$). For example, according to one non-limiting embodiment, the body may be cooled below $T_\beta$ and subsequently reheated and deformed at $T_3$. Alternatively, after processing at $T_2$, the body may be directly cooled such that at least the portion of the body to be deformed at $T_3$ attains a temperature $T_3$ that is above $T_\beta$ and no greater than $T_1$ throughout its extent, for example by furnace cooling or air cooling.

Non-limiting examples of methods of deforming the titanium alloy body at $T_3$ that may be used in accordance with various non-limiting embodiments disclosed herein include forging, cogging, extrusion, drawing, rolling, and various combinations thereof. Although not required, the body can be deformed at $T_3$ using the same deformation process as used to deform the body at $T_1$ or, alternatively, a different deformation process can be employed. Further, if the body was deformed at $T_2$, deforming the body at $T_3$ can be done using the same or a different deformation process.

As discussed above with respect to deformation of the body at $T_1$, according to various non-limiting embodiments disclosed herein, deforming the body at $T_3$ can involve a single deformation step or, alternatively, can involve multiple deformation steps. As previously discussed, if multiple deformation steps are employed, it may be necessary to subject the body to various reheating steps between deformation passes in order to maintain the temperature of the body within the desired range; however, it is not necessary that each pass be conducted at exactly the same temperature, provided that for each pass, the body is deformed at temperature that is greater than $T_\beta$ and no greater than $T_1$. Additionally, although not required, if multiple deformation steps are employed, the body may be cooled below $T_\beta$ between any consecutive passes provided that the body is reheated prior to deforming the body.

For example, according to one non-limiting embodiment, deforming the body at $T_3$ can comprise forging the body in multiple passes using the same or different forging techniques with each pass. For example, the deforming the body at $T_3$ may comprise deforming the body in one or more passes by press-forging the body in either a straight-draw or up-set forging operation, and deforming the body in one or more passes by rotary-forging the body in a straight-draw forging operation.

During deformation at $T_3$ the cross-sectional area of the body is further reduced and additional refinement of the beta grain structure may occur. According to various non-limiting embodiments disclosed herein, deforming the body at $T_3$ may comprise deforming the body to attain a total percent reduction in cross-sectional area of at least 15% up to 80% during deformation at $T_3$. According to other non-limiting embodiments, deforming the body at $T_3$ may comprise deforming the body to attain a total percent reduction in cross-sectional area ranging from about 20% to about 70% during deformation at $T_3$. Further, according other non-limiting embodiments, the total percent reduction in cross-sectional area may range from about 25% to 65%. However, it should be appreciated that the amount of work required will depend, in part, on the temperatures employed, as well as dimensions of the body. Thus, it is contemplated by the inventors that total reductions of less than 15% or more than 80% may be desirable in certain circumstances.

As previously discussed, conventional processing of titanium alloys often involves processing the alloy below its $T_\beta$ after recrystallization to break-up or refine the α-phase. In contrast, according to various non-limiting embodiments disclosed herein, after recrystallizing the alloy by holding or deforming the body at $T_2$, the body is deformed at a temperature $T_3$ that is above $T_\beta$ of the titanium alloy. Deforming the body at a temperature $T_3$ that is above $T_\beta$ of the titanium alloy after recrystallization can facilitate the attainment of a finer β-grain size in a finished product made from the body. More particularly, according to various non-limiting embodiments, $T_3$ may range from greater than $T_\beta$ up to $T_1$ (i.e., $T_1 \geqq T_3 > T_\beta$). According to one specific non-limiting embodiment $T_3$ may range from at least 50° F. greater than $T_\beta$ up to $T_1$. According to another non-limiting embodiment, $T_3$ may range from 50° F. to 800° F. greater than $T_\beta$ up to $T_1$. While it is contemplated by the inventors that for temperatures less than $T_\beta$+50° F., it may be difficult to ensure the temperature will not fall below $T_\beta$ during deformation using standard processing equipment, temperatures closer to $T_\beta$ may be used if greater temperature control is possible. Further, although not limiting herein, it is contemplated by the inventors that if $T_3$ exceeds $T_\beta$+800° F., excessive or selective grain growth may occur when the body is deformed at $T_3$, thereby resulting in a undesired microstructure. Nevertheless, the present disclosure contemplates the use of temperatures greater than $T_\beta$+800° F., provided that such undesired grain grown can be avoided.

Although not shown in FIG. 1, after deforming the body at $T_3$, according to various non-limiting embodiments disclosed herein, the body may be cooled to a temperature below $T_\beta$ of the alloy. For example, according to certain non-limiting embodiments, the body may cooled to ambient temperature by air cooling, forced air cooling, liquid quenching (using water, oil, or other suitable quenching medium), or another cooling method that results in cooling rates at least a fast as air cooling so as to prevent excessive grain growth during cooling.

Further, after deforming the body at $T_3$, the body may optionally be subjected to one or more standard finish processing steps to obtain the desired final size and/or to further refine the grain structure. For example, after deforming at $T_3$ the body may be cooled to ambient temperature and thereafter the surface of the alloy may be conditioned, for example, by removing any oxide scale that formed during processing; the alloy may be re-sized and the grain structure further refined by deforming the alloy above the $T_\beta$ of the alloy (e.g., by forging); and/or the alloy may be prepared for ultrasonic inspection, for example, by annealing the alloy, further conditioning the surface of the alloy, and/or by introducing a minor amount of deformation into the alloy below $T_\beta$ (e.g., no greater than 25 percent total reduction in cross-sectional area, and preferably less than 15 percent total reduction in cross-sectional area). As such additional processing steps are well known in the art, further discussion of these additional steps is not believed to facilitate a better understanding of the invention and has therefore been omitted.

Alternatively, according to various non-limiting embodiments disclosed herein, after recrystallization of the alloy and prior to deforming at least a portion of the alloy at $T_3$, or between deformation passes at $T_3$, the surface of the alloy can be conditioned to remove any undesired surface oxides, for example by grinding.

Other non-limiting embodiments disclosed herein provide a method of processing an α+β or a near-β titanium alloy, the method comprising: deforming the titanium alloy at a first temperature ($T_1$) that is above the beta-transus temperature ($T_\beta$) of the titanium alloy; recrystallizing at least a portion of the alloy by at least one of deforming or holding the titanium alloy at a temperature that is at least 50° F. greater than $T_1$; deforming the titanium alloy at a temperature ranging from greater than $T_\beta$ up to $T_1$; and cooling the titanium alloy to a temperature below $T_\beta$ without deforming the titanium alloy during cooling (i.e., the alloy is not intentionally deformed during cooling); wherein between the steps of deforming the titanium alloy at $T_1$ and cooling the titanium alloy to a temperature below $T_\beta$, deformation of the titanium alloy occurs only at temperatures above $T_\beta$. More particularly, according to certain non-limiting embodiments, deformation of the titanium alloy may occur only at temperatures above $T_\beta$ during the method of processing the titanium alloy. Suitable alloy compositions, processing temperatures and times, deformation methods and reductions, and other features that may be used in conjunction with these non-limiting embodiments are described above in detail.

As discussed above, conventional processing of $\alpha+\beta$ or a near-$\beta$ titanium alloys generally involves deformation processes that occur below $T_\beta$ of the alloy in the $\alpha+\beta$ phase field to introduce pre-strain into the alloy to promote subsequent recrystallization or to refine the $\alpha$-phase. However, as previously discussed, the inventors herein have discovered that it is possible to reduce the occurrence of SIP, while still obtaining a desired microstructure, by processing the alloy such that deformation of the alloy occurs only temperatures above $T_\beta$ of the alloy.

Still other non-limiting embodiments disclosed herein provide a method of processing a cast ingot, which may be a homogenized cast ingot, of an $\alpha+\beta$ or a near-$\beta$ titanium alloy, the method comprising heating the ingot until at least a portion of the ingot attains a first temperature ($T_1$) that is at least 50° F. above the beta-transus temperature ($T_\beta$) of the titanium alloy; deforming the ingot at $T_1$ to attain a total percent reduction in cross-sectional area of at least 15 percent during deformation at $T_1$; heating the ingot until at least a portion of the ingot attains a second temperature ($T_2$) that is at least 50° F. greater than $T_1$; at least one of deforming the ingot at $T_2$ to recrystallize at least a portion of the titanium alloy and holding the ingot at $T_2$ for a time period sufficient to recrystallize at least a portion of the titanium alloy; allowing at least a portion of the ingot to attain a third temperature ($T_3$), wherein $T_1 \geqq T_3 > T_\beta$; and deforming the ingot at $T_3$ to attain a total percent reduction in cross-sectional area of at least 15 percent during deformation at $T_3$, and wherein between the steps of deforming the ingot at $T_1$ and deforming the ingot at $T_3$, essentially no deformation of the ingot occurs at a temperature below $T_\beta$. Suitable alloy compositions, processing temperatures (i.e., $T_1$, $T_2$, $T_3$) and times, deformation methods and reductions, and other features that may be used in conjunction with these non-limiting embodiments are described above in detail.

According to one non-limiting embodiment disclosed herein, between the steps of deforming the ingot at $T_1$and heating the ingot to $T_2$ discussed above, the ingot may be cooled below $T_\beta$. Additionally or alternatively, between the steps of deforming and/or holding the ingot at $T_2$ and deforming the ingot at $T_3$ (discussed above), the ingot may be cooled below $T_\beta$, provided that prior to deforming the ingot at $T_3$, the ingot is reheated to at least $T_3$.

As indicated above, after deforming the ingot at $T_3$ according to various non-limiting embodiments disclosed herein, the ingot may be cooled below $T_\beta$, for example, to ambient temperature. Further, although not required, according to certain non-limiting embodiments disclosed herein after deforming the ingot at $T_3$ and cooling the ingot to a temperature below $T_\beta$, the ingot may be subjected to minor amounts of deformation (e.g., no greater than 25 percent total reduction in cross-sectional area, and preferably less than 15 percent total reduction in cross-sectional area). As previously discussed, such minor amounts of deformation may aid in preparing the alloy for ultrasonic inspection without refining the grain structure. However, significant deformation of the body below $T_\beta$ after recrystallization and deformation at $T_3$ is avoided to reduce or prevent the occurrence of SIP.

The methods of processing $\alpha+\beta$ and near-$\beta$ titanium alloy bodies disclosed herein may be useful in preparing billets or other mill products or semi-finished products that are essentially free of SIP formation from cast ingots of $\alpha+\beta$ and near-$\beta$ titanium alloys. As used herein the term "essentially free of SIP formation" means that the bodies have no SIP formation, or the occurrence of SIP formation is so minor as to be inconsequential to the mechanical properties of the alloy. Non-limiting examples of mill or semi-finished products that may be produced from cast ingots according to the methods disclosed herein include billets, rods, bars, coils, slabs, sheets, plates and the like.

Aspects of the present invention disclosed herein are illustrated in the following non-limiting example. It should be appreciated that the following non-limiting example is provided for illustration purposes and not intend to limit the scope of the invention as set forth in the claims.

EXAMPLE

Part 1: Alloy Processing

An ingot of a Ti-17 near-$\beta$ titanium alloy was cast and homogenized, and subsequently processed in accordance with various non-limiting embodiments for processing titanium alloys set forth above as follows. The $T_\beta$ of the alloy was approximately 1635° F., as determined by metallographic observation of samples of the material that were heat treated in 10-15° F. increments between 1610° F. and 1660° F. The nominal composition of the ingot is give below in Table 2.

TABLE 2

| Element | Weight Percent |
|---|---|
| Al | 5.0 |
| C | 0.03 |
| Cr | 4.0 |
| Cu | 0.05 |
| Fe | 0.15 |
| H | 0.015 max |
| Mn | 0.05 |
| Mo | 4.0 |
| N | 0.02 |
| O | 0.11 |
| Zr | 2.0 |
| Sn | 2.0 |
| Ti + impurities | Balance |

The ingot was heated to 1950° F.±25° F. (about $T_\beta$+315° F.) ("$T_1$"), and straight draw forged at $T_1$ to attain a reduction in cross-sectional area of about 32%. Thereafter, the ingot was reheated to $T_1$ and subjected to a second pass of straight draw forging at $T_1$ to attain a total (i.e., resulting from the first and second passes) reduction in cross-sectional area of about 53% while deforming the ingot at $T_1$. After deforming the ingot at $T_1$, the ingot was cooled below $T_\beta$ of the alloy by subjecting the ingot to forced air cooling for approximately 4 hours.

The ingot was subsequently recrystallized by holding the alloy at 2050° F.±25° F. (about $T_1$+100° F.)("$T_2$"), for approximately 4 hours, 45 minutes. After completion of the hold period, the ingot was water quenched.

The ingot was then deformed at 1750° F.±25° F. ("$T_3$"). Deformation at $T_3$ was done in multiple passes as follows: two passes of press-forging at about a 30% reduction in cross-sectional area per pass, one pass of press-forging at about a 32.5% reduction in cross-sectional area, and three passes of rotary-forging at about a 28% reduction in cross-sectional area per pass, to attain a total reduction in cross-sectional area of about 83% while deforming the ingot at $T_3$. Between each pass, the ingot was reheated to $T_3$. Prior to the third press-forging pass (i.e., press-forging at about a 32.5% reduction in area), the ingot was ground to remove surface scale, and after the third press-forging pass, the ingot was fan cooled for approximately 4 hours prior to reheating. After the final deformation pass at $T_3$, the ingot was cooled below $T_\beta$ of the alloy by subjecting the ingot to air cooling for approximately 4 hours.

After deforming the ingot at $T_3$, the ingot was subjected to standard finishing operations, including surface conditioning and an annealing step to prepare the ingot for ultrasonic inspection.

Part 2: Microstructural Comparison

Figure 2:
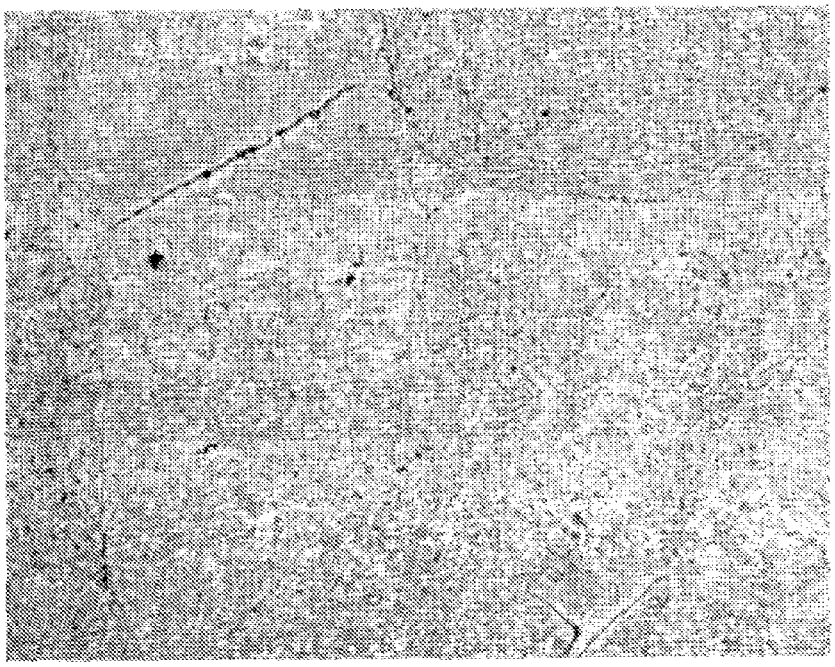
FIG. 2 is an optical micrograph of a near-β titanium alloy processed in accordance with various non-limiting embodiments of the present disclosure.
Figure 3:
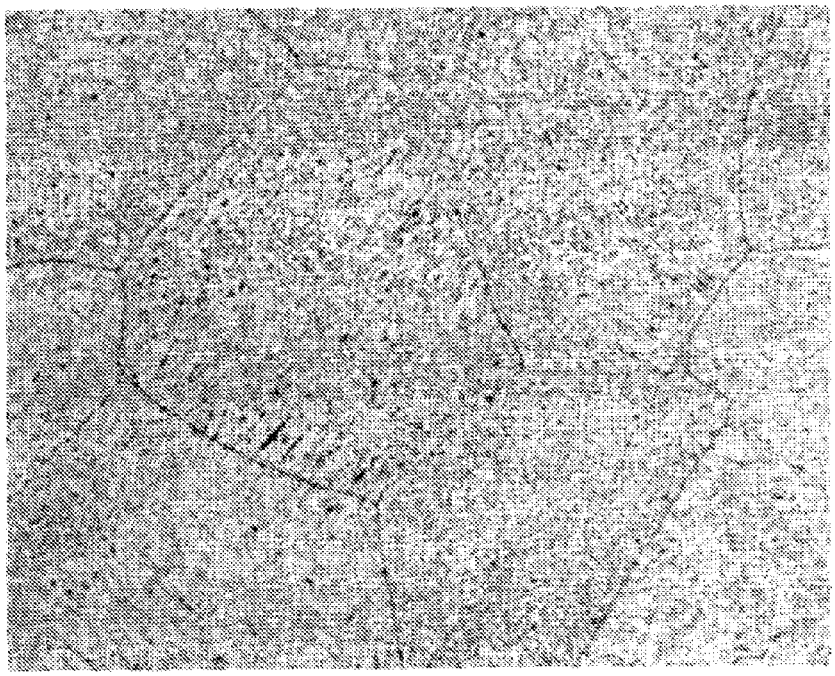
FIG. 3 is an optical micrograph of a conventionally processed near-β titanium alloy.

Referring now to FIGS. 2 and 3. FIG. 2 is an optical micrograph taken of a sample of the alloy processed as set forth above in Part 1. FIG. 3 is an optical micrograph of a Ti-17 alloy (commercially available as Allvac Ti-17 alloy from ATI Allvac of Monroe, N.C.) that was conventionally processed using an $\alpha+\beta$ pre-strain process. The micrographs of FIGS. 2 and 3 were taken at the same magnification.

The microstructure of the alloy that was processed in accordance with various non-limiting embodiments of the present invention without deformation in the $\alpha+\beta$ phase field, shown in FIG. 2, is substantially similar to the comparative microstructure of the alloy that was processed using a conventional $\alpha+\beta$ pre-strain process (i.e., deformation in the $\alpha+\beta$ phase field), shown in FIG. 3.

Part 3: Ultrasonic Inspection

The ingot processed as discussed above in Part 1 was subjected to a standard multi-zone ultrasonic inspection process using five transducers, each of which was focused to a different depth within the ingot. The results of this inspection indicated that the ingot was free of defects, such as SIP, and had similar background noise levels as compared to conventionally processed Ti-17 alloys. It is contemplated by the inventors that the similar in background noise level may be attributable to the similarity in macrostucture and microstructure between conventionally processed material and the material processed as discussed in Part 1.

As previously discussed, it is to be understood that the present description illustrates aspects of the invention relevant to a clear understanding of the invention. Certain aspects of the invention that would be apparent to those of ordinary skill in the art and that, therefore, would not facilitate a better understanding of the invention have not been presented in order to simplify the present description. Although the present invention is described herein in connection with certain embodiments and examples, the present invention is not limited to the particular embodiments and examples disclosed, but is intended to cover modifications that are within the spirit and scope of the invention, as defined by the appended claims.

What is claimed is:

1. A method of processing a titanium alloy comprising:

deforming a body of a titanium alloy at a first temperature ($T_1$) that is above the beta-transus temperature ($T_\beta$) of the titanium alloy;

at least one of: (i) deforming the body at a second temperature ($T_2$), wherein $T_2$ is at least 50° F. greater than $T_1$ to recrystallize at least a portion of the titanium alloy, or (ii) holding the body at $T_2$ for a time period sufficient to recrystallize at least a portion of the titanium alloy; and deforming the body at a third temperature ($T_3$), wherein $T_1 \geqq T_3 > T_\beta$;

wherein the titanium alloy is one of an alpha+beta alloy and a near-beta alloy, and wherein essentially no deformation of the body occurs at a temperature below $T_\beta$ during the method of processing the titanium alloy.

2. The method of claim 1 wherein the titanium alloy is an alpha+beta alloy.

3. The method of claim 2 wherein the alpha+beta titanium alloy is Ti-6Al-4V.

4. The method of claim 1 wherein the titanium alloy is a near-beta titanium alloy.

5. The method of claim 4 wherein the near-beta titanium alloy is one of Ti-5Al-2Sn-2Zr-4Mo-4Cr, Ti-6Al-2Sn-2Zr-2Cr-2Mo-0.15Si, and Ti-4.5Al-3V-2Mo-2Fe.

6. The method of claim 1 wherein the body is a homogenized cast ingot.

7. The method of claim 1 wherein deforming the body at $T_1$ includes at least one of forging, cogging, extrusion, drawing and rolling.

8. The method of claim 1 wherein deforming the body at $T_1$ comprises deforming the body at $T_1$ to attain a total percent reduction in cross- sectional area of at least 15 percent during deformation at $T_1$.

9. The method of claim 1 wherein deforming the body at $T_1$ comprises deforming the body at $T_1$ to attain a total percent reduction in cross-sectional area ranging from 20 percent to 70 percent during deformation at $T_1$.

10. The method of claim 1 wherein deforming the body at $T_1$ comprises deforming the body at $T_1$ to attain a total percent reduction in cross-sectional area ranging from 25 percent to 65 percent during deformation at $T_1$.

11. The method of claim 1 wherein $T_1$ is at least 50° F. greater than $T_\beta$.

12. The method of claim 1 wherein $T_1$ ranges from 50° F. greater than $T_\beta$ to 800° F. greater than $T_\beta$.

13. The method of claim 1 further comprising cooling the body to a temperature below $T_\beta$ of the titanium alloy after deforming at $T_1$ and prior to at least one of deforming the body at $T_2$ or holding the body at $T_2$.

14. The method of claim 1 wherein $T_2$ ranges from $T_1$+50° F. to $T_1$+800° F.

15. The method of claim 1 wherein $T_2$ ranges from $T_1$+75° F. to $T_1$+500° F.

16. The method of claim 1 wherein $T_2$ ranges from $T_1$+100° F. to $T_1$+200° F.

17. The method of claim 1 wherein $T_2$ is at least $T_1$+150° F.

18. The method of claim 1 wherein prior to deforming the body at $T_3$, the body is subjected to at least two cycles of deforming the body at $T_1$ and deforming or holding the body at $T_2$, wherein for each of the at least two cycles $T_1$ is independently chosen and ranges from $T_\beta$+50° F. to $T_\beta$+800° F. and $T_2$ is independently chosen and ranges from $T_1$+50° F. to $T_1$+800° F.

19. The method of claim 1 wherein prior to deforming the body at $T_3$, the body is cooled from $T_2$ to a temperature below $T_\beta$ of the titanium alloy and is subsequently heated at $T_3$.

20. The method of claim 1 wherein deforming the body at $T_3$ comprises forging the body.

21. The method of claim 1 wherein deforming the body at $T_3$ comprises deforming the body at $T_3$ to attain a total percent reduction in cross-sectional area of at least 15 percent during deformation at $T_3$.

22. The method of claim 1 wherein deforming the body at $T_3$ comprises deforming the body at $T_3$ to attain a total percent reduction in cross-sectional area ranging from 20 percent to 70 percent during deformation at $T_3$.

23. The method of claim 1 wherein deforming the body at $T_3$ comprises deforming the body at $T_3$ to attain a total percent reduction in cross-sectional area ranging from 25 percent to 65 percent during deformation at $T_3$.

24. The method of claim 1 wherein $T_3$ is at least 50° F. greater than $T_\beta$.

25. The method of claim 1 wherein $T_3$ ranges from 50° F. greater than $T_\beta$ to 800° F. greater than $T_\beta$.

26. The method of claim 1 wherein after deforming the body at $T_3$ the alloy is cooled to an ambient temperature by at least one of air cooling, forced air cooling and liquid quenching.

27. The method of claim 1 wherein after conducting the method of processing, the body is essentially free of strain induced porosity.

28. A method of processing an alpha+beta or a near-beta titanium alloy, the method comprising:

deforming the titanium alloy at a first temperature ($T_1$) that is above the beta-transus temperature ($T_\beta$) of the titanium alloy;

recrystallizing at least a portion of the titanium alloy by at least one of deforming or holding the titanium alloy at a temperature that is at least 50° F. greater than $T_1$;

deforming the titanium alloy at a temperature ranging from greater than $T_\beta$ up to $T_1$; and cooling the titanium alloy to a temperature below $T_\beta$ without deforming the titanium alloy during cooling;

wherein between the steps of deforming the titanium alloy at $T_1$ and cooling the titanium alloy to a temperature below $T_\beta$, deformation of the titanium alloy occurs only at temperatures above $T_\beta$.

29. A method of processing an ingot of a titanium alloy, the method comprising:

heating the ingot until at least a portion of the ingot attains a first temperature that is at least 50° F. above the beta-transus temperature ($T_\beta$) of the titanium alloy;

deforming the ingot at $T_1$ to attain a total percent reduction in cross-sectional area of at least 15 percent during deformation at $T_1$;

heating the ingot until at least a portion of the ingot attains a second temperature ($T_2$) that is at least 50° F. greater than $T_1$;

at least one of (i) deforming the body at $T_2$ to recrystallize at least a portion of the titanium alloy, and (ii) holding the ingot at $T_2$ for a time period sufficient to recrystallize at least a portion of the titanium alloy;

allowing at least a portion of the ingot to attain a third temperature ($T_3$), wherein $T_1 \geqq T_3 > T_\beta$; and deforming the ingot at $T_3$ to attain a total percent reduction in cross-sectional area of at least 15 percent during deformation at $T_3$, wherein the titanium alloy is one of an alpha+beta titanium alloy and a near-beta titanium alloy, and wherein between the steps of deforming the ingot at $T_1$ and deforming the ingot at $T_3$, essentially no deformation of the ingot occurs at a temperature below $T_\beta$.

30. The method of claim 29 wherein subsequent to deforming the ingot at $T_3$, the ingot is cooled to a temperature below $T_\beta$ and deformed to attain a total percent reduction in cross-sectional area of no greater than 25 percent.

* * * * *

UNITED STATES PATENT AND TRADEMARK OFFICE

CERTIFICATE OF CORRECTION

PATENT NO. : 7,611,592 B2
APPLICATION NO. : 11/360065
DATED : November 3, 2009
INVENTOR(S) : Davis et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 597 days.

Signed and Sealed this

Twelfth Day of October, 2010

David J. Kappos

David J. Kappos
*Director of the United States Patent and Trademark Office*